US009080359B2

(12) United States Patent
Horwood

(10) Patent No.: US 9,080,359 B2
(45) Date of Patent: Jul. 14, 2015

(54) ROLLER ASSEMBLY

(75) Inventor: Stuart G. Horwood, Auckland (NZ)

(73) Assignee: Assa Abloy New Zealand, Albany (NZ)

( * ) Notice: Subject to any disclaimer, the term of this patent is extended or adjusted under 35 U.S.C. 154(b) by 0 days.

(21) Appl. No.: 14/342,802

(22) PCT Filed: Aug. 31, 2012

(86) PCT No.: PCT/NZ2012/000155
§ 371 (c)(1),
(2), (4) Date: May 22, 2014

(87) PCT Pub. No.: WO2013/073964
PCT Pub. Date: May 23, 2013

(65) Prior Publication Data

US 2014/0310913 A1 Oct. 23, 2014

(30) Foreign Application Priority Data

Sep. 8, 2011 (NZ) ..... 595067

(51) Int. Cl.
*E05D 15/00* (2006.01)
*E05D 15/06* (2006.01)

(52) U.S. Cl.
CPC ..... *E05D 15/0669* (2013.01); *E05Y 2600/12* (2013.01); *E05Y 2600/31* (2013.01); *E05Y 2600/312* (2013.01); *E05Y 2900/132* (2013.01); *Y10T 16/3819* (2015.01)

(58) Field of Classification Search
USPC ..... 16/105, 91, 97, 99, 102, 106, 107, 32; 49/425, 428, 432, 346; 160/84.06, 160/84.08, 107, 108, 345, 346, 347
See application file for complete search history.

(56) References Cited

U.S. PATENT DOCUMENTS 3,696,560 A * 10/1972 Hallin ..... 49/425
4,262,451 A * 4/1981 Dallaire ..... 49/425

(Continued)

FOREIGN PATENT DOCUMENTS

AU 640606 5/1993
AU 725099 3/2000

(Continued)

*Primary Examiner* — Chuck Mah
(74) *Attorney, Agent, or Firm* — DeLio, Peterson & Curcio, LLC.; Peter W. Peterson

(57) ABSTRACT

A roller assembly comprising: a roller housing comprising first and second side walls and first and second end walls forming an enclosure; a carriage assembly comprising a carriage body and at least two carriage wheels rotatably attached to the carriage body, wherein the carriage assembly is located within the enclosure such that the at least two carriage wheels are arranged to protrude from the bottom of the enclosure during use; wherein the carriage body comprises a support portion and at least two concentric pivot points arranged to locate within slanted passages formed in the first and second side walls to allow the carriage body to rotatably pivot about the pivot points; an intermediate adjusting mechanism slidably engaged with the roller housing and arranged to move lengthwise within the enclosure, the intermediate adjusting mechanism comprising a first engagement surface located on an extending member, wherein the extending member extends in a direction substantially perpendicular to the lengthwise movement of the intermediate adjusting mechanism and the first engagement surface is arranged to engage with the support portion; and an adjustment mechanism that passes through an adjustment aperture formed in the first end wall, whereupon movement of the adjustment mechanism the intermediate adjusting mechanism is caused to move lengthwise within the enclosure, wherein the movement of the intermediate adjusting mechanism causes the carriage body to move along the slanted passage.

12 Claims, 5 Drawing Sheets

(56) References Cited

U.S. PATENT DOCUMENTS

| | | | | |
|---|---|---|---|---|
| 4,633,615 | A | 1/1987 | Moose | |
| 5,950,279 | A * | 9/1999 | Chaput | 16/105 |
| 2005/0011041 | A1 * | 1/2005 | Ness | 16/105 |
| 2009/0019665 | A1 * | 1/2009 | Kelley | 16/105 |

FOREIGN PATENT DOCUMENTS

| | | | |
|---|---|---|---|
| AU | 200148102 | | 12/2001 |
| AU | 2004201171 | | 10/2004 |
| AU | 2004233485 | | 12/2004 |
| AU | 2006202139 | | 2/2007 |
| AU | 2007202099 | | 5/2007 |
| AU | 2007203108 | | 1/2008 |
| AU | 2007219271 | | 1/2009 |
| AU | 2009208119 | | 3/2012 |
| CN | 201924728 | U * | 8/2011 |
| EP | 2017417 | A1 * | 1/2009 |
| GB | 2142365 | | 1/1985 |
| GB | 2309477 | | 7/1997 |
| NZ | 330361 | | 3/2000 |
| NZ | 561868 | | 1/2009 |
| WO | WO 2011100788 | A1 * | 8/2011 |

* cited by examiner

ROLLER ASSEMBLY

FIELD OF THE INVENTION

The present invention relates to a roller assembly. In particular, the present invention relates to a roller assembly with an intermediate adjusting mechanism.

BACKGROUND

Roller assemblies are installed at the bottom of heavy sliding doors to enable the doors to slide.

These roller assemblies generally have a carriage with wheels attached, the carriage being enclosed within a housing.

Various prior arrangements have been used in order to adjust the roller assembly to enable the door to be adjusted in height relative to the surface upon which the roller assembly moves.

Early adjustment mechanisms utilised an adjustment screw which was in direct contact with the carriage of the roller assembly. The carriage was located within a diagonal slot on the housing or placed on an internal ramp within the housing so that when the carriage was pushed from the side by the adjustment screw, the carriage moved up and down. Therefore, by turning the adjustment screw, the height of the door relative to the floor could be adjusted.

However, in these devices the adjustment screw was in direct contact with the carriage and so caused steel on steel contact between the two components. This resulted in increased wear and tear as well as difficulty in performing the adjustment. Further, as the screw is in direct contact with the carriage, the carriage was unable to freely pivot within the diagonal slot.

In further examples of roller assemblies, intermediate components were placed between the screw adjustment and the carriage assembly in order to reduce the problems associated with the steel on steel contact. However, these devices did not enable the carriage assembly to be freely moved up and down whilst also enabling it to freely pivot without causing undue stress on the intermediate components.

An object of the present invention is to provide an improved roller assembly or to at least provide the public with a useful choice.

Further advantages of the invention will be brought out in the following portions of the specification, wherein the detailed description is for the purpose of fully disclosing the preferred embodiment of the invention without placing limitations thereon.

The background discussion (including any potential prior art) is not to be taken as an admission of the common general knowledge in the art in any country. Any references discussed state the assertions of the author of those references and not the assertions of the applicant of this application. As such, the applicant reserves the right to challenge the accuracy and relevance of the references discussed.

SUMMARY OF THE INVENTION

It is acknowledged that the terms "comprise", "comprises" and "comprising" may, under varying jurisdictions, be attributed with either an exclusive or an inclusive meaning. For the purpose of this specification, and unless otherwise noted, these terms are intended to have an inclusive meaning—i.e. they will be taken to mean an inclusion of the listed components that the use directly references, but optionally also the inclusion of other non-specified components or elements. It will be understood that this intended meaning also similarly applies to the terms mentioned when used to define steps in a method or process.

According to one aspect, the present invention provides a roller assembly comprising: a roller housing comprising first and second side walls; a carriage assembly comprising a carriage body and at least two carriage wheels rotatably attached to the carriage body, wherein the carriage assembly is located within the housing such that the at least two carriage wheels are arranged to protrude from the bottom of the housing during use; wherein the carriage body comprises a support portion and at least two pivot points defining a pivot axis, the pivot points being arranged to locate within slanted passages formed in the first and second side walls, the carriage body being free to rotatably pivot about the pivot axis; an intermediate adjusting mechanism slidably engaged with the roller housing and arranged to move lengthwise with respect to the housing, the intermediate adjusting mechanism comprising a first engagement surface arranged to engage with the support portion; and an adjustment mechanism accessible from a first end of the housing, wherein movement of the adjustment mechanism causes the intermediate adjusting mechanism to move lengthwise with respect to the housing, wherein the movement of the intermediate adjusting mechanism causes or allows the carriage body to move along the slanted passage.

Preferably the adjustment mechanism is arranged to be moved rotationally within the adjustment aperture.

Preferably the lengthwise movement of the intermediate adjusting mechanism has no vertical component.

Preferably the roller housing further comprises a first lengthwise adjustment passage located on the first side wall and a second lengthwise adjustment passage located on the second side wall, wherein the intermediate adjusting mechanism further comprises a first protrusion arranged to move within the first lengthwise adjustment passage and a second protrusion arranged to move within the second lengthwise adjustment passage.

Preferably the adjustment mechanism comprises a rotatable element that engages with a fixed element, wherein the fixed element engages with the intermediate adjusting mechanism such that the rotation of the rotatable element causes the fixed element to move along the length of the rotatable element thus causing the intermediate adjusting mechanism to move lengthwise.

Preferably the rotatable element is an adjustment screw and the fixed element is a corresponding adjustment nut, wherein the adjustment nut is located within an adjustment nut aperture formed within the intermediate adjusting mechanism.

Preferably the fixed element is formed integrally with the intermediate adjusting mechanism.

Preferably the carriage assembly further comprises at least two shafts, each shaft being arranged to pass through a central aperture formed in one of the carriage wheels to enable that carriage wheel to rotate relative to the carriage assembly.

Preferably the roller assembly further comprises a first slanted passage formed in the first wall and a second slanted passage formed in the second wall, where the first and second slanted passages are aligned and slant in the same direction.

Preferably the carriage body comprises a first pivot point arranged to locate within the first slanted passage and a second pivot point arranged to locate within the second slanted passage.

Preferably the support portion comprises a round surface that is concentric with the pivot points and the first engagement surface of the extending member is arranged to engage with the round surface when the intermediate adjusting mechanism moves lengthwise.

Preferably the first engagement surface acts against the support portion to hold the carriage body in position when it is not being adjusted.

Preferably the first engagement surface is located on an extending member, wherein the extending member extends in a direction substantially perpendicular to the lengthwise movement of the intermediate adjusting mechanism.

Preferably the roller housing further includes first and second end walls.

BRIEF DESCRIPTION OF THE DRAWINGS

Embodiments of the present invention will now be described, by way of example only, with reference to the accompanying drawings, in which.

DETAILED DESCRIPTION OF THE INVENTION

First Embodiment

Figure 1:
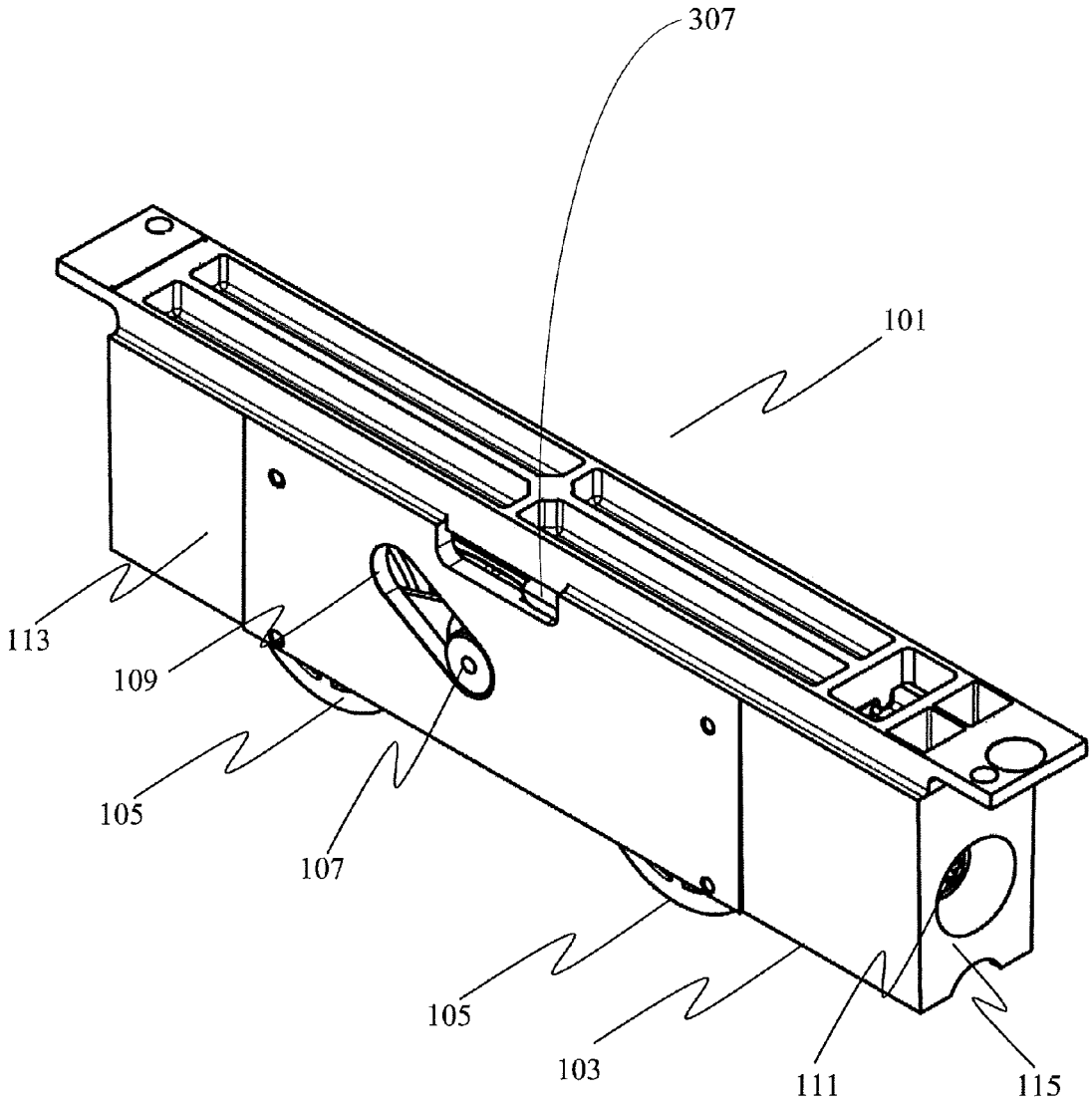
FIG. 1 shows a first view of an assembled roller assembly according to an embodiment of the present invention.

According to this first embodiment a roller assembly as shown in FIG. 1 is described. FIG. 1 shows a first side view of the roller assembly 101.

A housing 103 generally includes an enclosure formed of first and second side walls. The first and second side walls may be connected to each other. In the embodiment shown the housing is formed from a first side wall 113, a second side wall 201 (see FIG. 2), a first end wall 115 and a second end wall 203 (see FIG. 2). According to this embodiment, the housing is made from glass filled nylon. It will be understood however that any other suitable material may be used, such as, for example, other engineering plastic, die cast zinc, pressed metals or other materials, or other similar material. These walls (113, 201, 115 and 203) form an enclosure within the roller housing.

Figure 3:
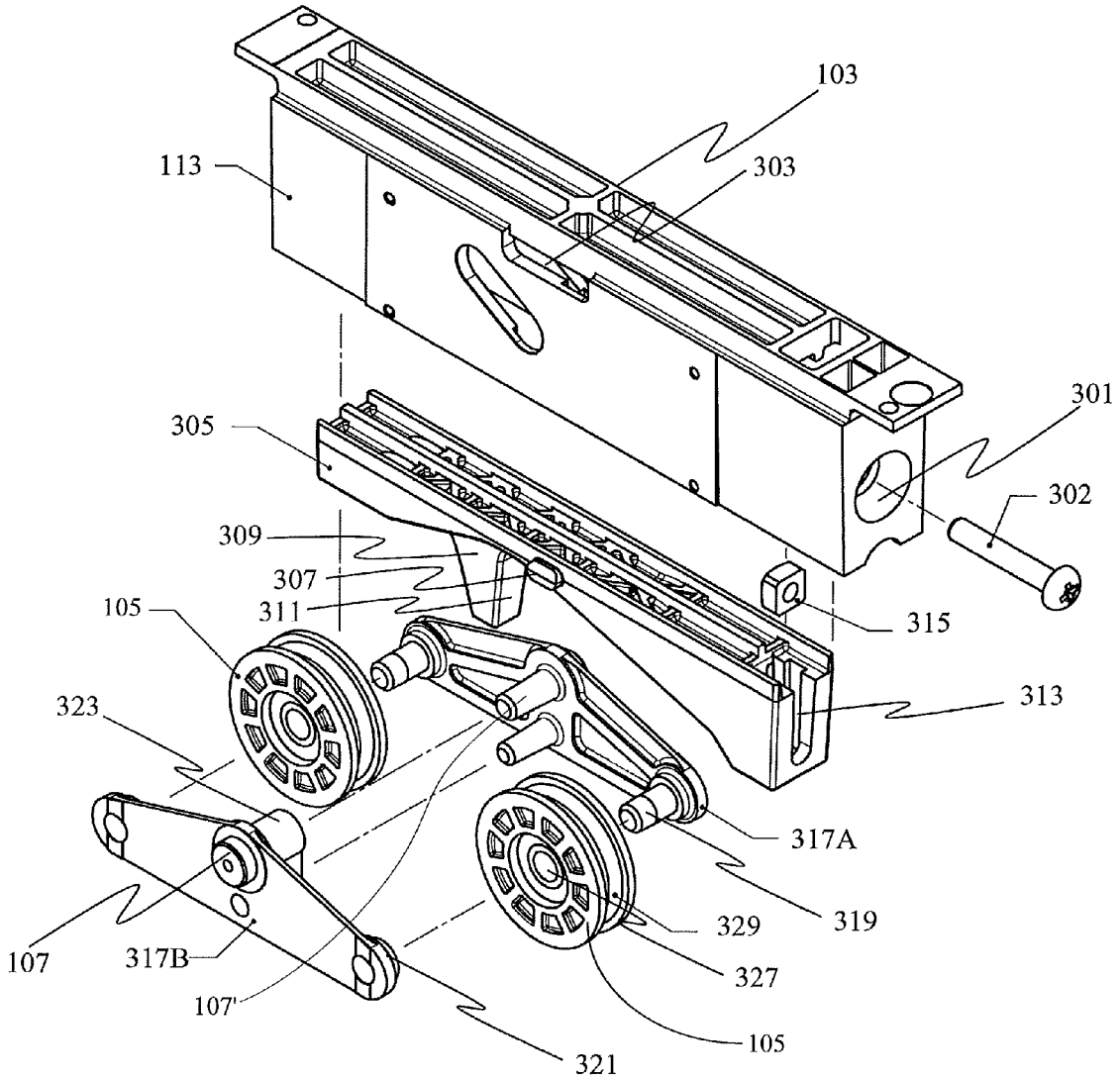
FIG. 3 shows an exploded view of a roller assembly according to an embodiment of the present invention.

Located within the enclosure is a carriage assembly (see FIG. 3). The carriage assembly includes two carriage wheels 105 which are arranged to protrude from the bottom of the enclosure during use of the roller assembly. It will be understood that, as an alternative, there may be more than two carriage wheels included in the carriage assembly.

Also forming part of the carriage assembly is one of two concentric pivot points 107 that are arranged to locate within slanted passages or tracks 109 formed in the first and second side walls (113 and 201). That is, the two concentric pivot points are located either side of the carriage assembly. The opposing slanted passages 109 are aligned and slanted in the same direction. The pivot points on the carriage assembly enable the carriage body of the carriage assembly to rotatably pivot about a pivot axis defined by the pivot points, as explained in more detail below.

The term "passage" means any suitable passage, track, or the like.

An adjustment mechanism 111 is provided to enable the carriage assembly to be adjusted relative to the roller assembly housing 103, as will be explained in more detail below.

Figure 2:
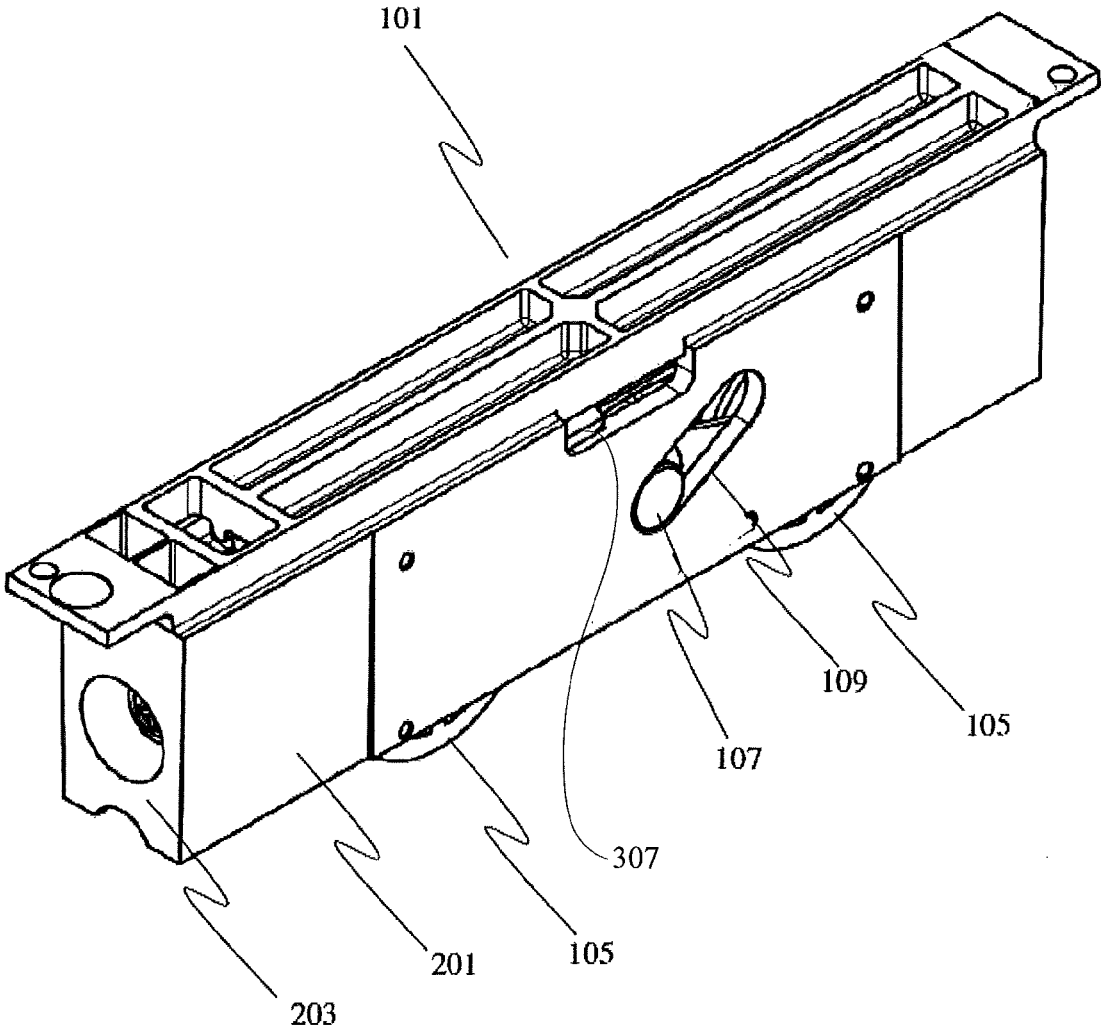
FIG. 2 shows a second view of an assembled roller assembly according to an embodiment of the present invention.

FIG. 2 shows a second view of the assembled roller assembly. According to this view, the second side wall 201 and a second end wall 203 are clearly seen. Further, the slanted passage 109 in the second side wall can also be seen to locate the second pivot point 107.

FIG. 3 shows an exploded view of the roller assembly. As can be seen in this exploded view, the roller housing 103 includes an adjustment aperture 301 formed in the first end wall 115. The adjustment mechanism 111 includes an adjustment element, which may be a rotatable element 302. According to this embodiment the rotatable element 302 is in the form of an adjustment screw. This rotatable element 302 passes through the adjustment aperture 301. In general the adjustment mechanism is preferably accessible from a first end of the enclosure. The roller assembly may be installed with a slot or hole leading from the first end to an end surface of the door. This allows a user to adjust the mechanism in an installed sliding door.

Located at the top edge of the first side wall 113 is a first lengthwise adjustment passage 303. According to this embodiment the passage is an aperture formed lengthwise along with the first side wall's upper edge. As can be seen in FIG. 2, a second lengthwise adjustment passage is also provided on the second side wall.

The lengthwise adjustment passages form a channel in which an intermediate adjusting mechanism 305 is slidably engaged with the roller housing. The intermediate adjusting mechanism is an adjusting bar that is arranged to move lengthwise within the enclosure of the housing, i.e. along the length of the housing, upon the adjustment mechanism being moved or operated.

The adjusting bar has a first protrusion 307 that protrudes from a side surface of the bar located near to the top edge of the adjusting bar. This first protrusion 307 is located approximately at a central position along the length of the adjusting bar. A second protrusion (not shown) is located on the opposing side surface of the bar. The first and second protrusions are formed so that they locate within the first and second lengthwise adjustment passages. Once the adjusting bar has been inserted within the roller housing it is then able to move lengthwise backwards and forwards within the housing along the lengthwise adjustment passages. In some embodiments there may be two or more first protrusions and/or two or more second protrusions configured to locate within any appropriate number of lengthwise adjustment passages.

Protruding from the bottom of the adjusting bar is an extending member 309. The extending member 309 extends in a direction substantially perpendicular to the lengthwise movement of the adjusting bar. The extending member includes an engagement surface 311 that is arranged to engage with the carriage assembly, as will be explained in more detail below. The engagement surface 311 lies in a plane that is substantially perpendicular to the axis along which the adjusting bar moves lengthwise. In other embodiments any suitable formation may be used to provide an engagement surface that is arranged to act against the support portion of the carriage assembly.

Within an end portion of the adjusting bar 305 that corresponds with the end portion of the roller housing which locates the adjusting mechanism 111 is located an adjustment aperture 313. This adjustment aperture 313 has a vertical slot that accommodates a fixed element 315. According to this embodiment the fixed element 315 is a nut. This fixed element 315 forms part of the adjustment mechanism 111. The nut 315 includes an internal thread which corresponds with the thread on the screw 302.

It will be understood that, as an alternative, a separate fixed element is not required. For example, the adjusting bar may incorporate an integral component that includes a thread to accommodate the screw 302.

According to this arrangement of the adjustment mechanism, it can clearly be seen that as the adjustment screw 302 is rotated this causes the adjusting bar to move lengthwise within the lengthwise adjustment passages by moving the nut (fixed element) along the length of the screw (rotatable element).

The carriage assembly includes a carriage body made up of two opposing halves 317A and 317B. According to this embodiment, the carriage assembly is made from die cast zinc. However, it will be understood that, as an alternative, any other suitable material may be used such as, for example, any moulded engineering polymer, or pressed material.

A first half of the carriage body 317A includes a number of shafts 319. Two outer shafts are used to attach the carriage wheels 325 to the carriage assembly. The two outer shafts are arranged to be located within corresponding apertures 321 formed on the second half of the carriage body 3178. The shafts and corresponding apertures form interlocking portions that enable the two halves of the carriage to be connected together.

Two vertically aligned inner shafts (the upper of which is labelled 107') are arranged to locate within corresponding apertures formed within a supporting portion 323 located on the second half of the carriage body 3178.

Each of the two carriage wheels 105 has formed therein a central aperture 327 that accommodates the shafts 319. This enables the carriage wheels to rotate relative to the carriage assembly, around the axle formed by the outer shaft 319. Further, each of the two carriage wheels 105 have a groove portion 329 formed around the rim of the wheel to accommodate a track formed within the floor where the roller assembly will be located. In some embodiments the rim of the carriage wheel may be formed with any suitable shape to match the shape of a particular track.

Figure 4A:
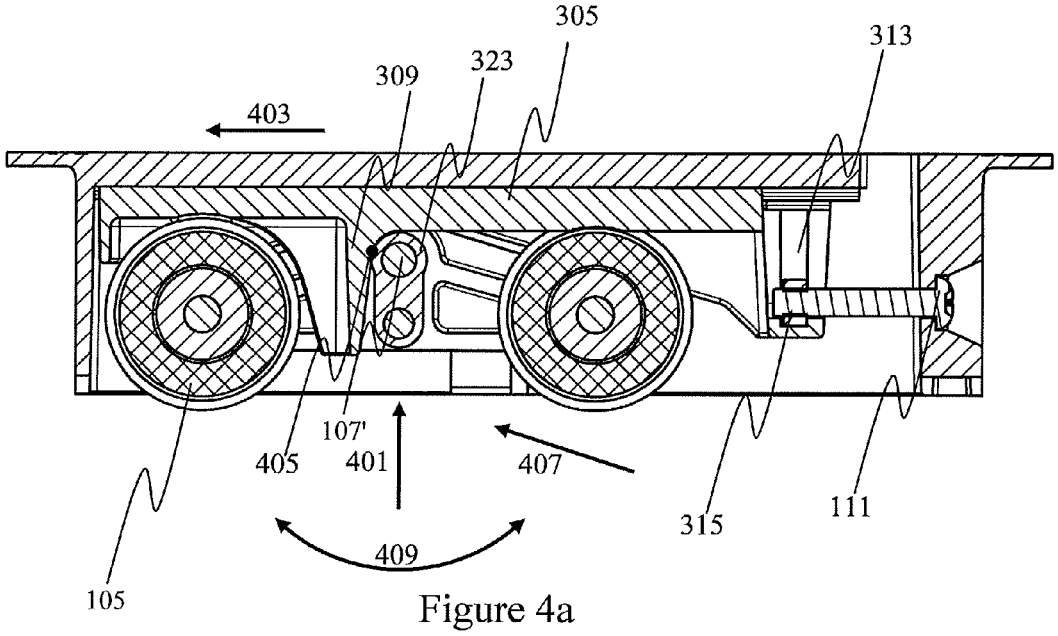
FIG. 4A shows a cross sectional view of a roller assembly in a first position according to an embodiment of the present invention.

FIG. 4A shows a cross sectional view of the roller assembly with various components arranged in a first position.

FIG. 4A shows the roller assembly where the carriage assembly is located at its uppermost position as indicated by the arrow 401. That is, the carriage assembly wheels are retracted within the roller assembly housing. In order to adjust the roller assembly so that it is in this configuration, the adjustment screw 111 is turned in an anticlockwise direction. This causes the adjustment nut 315 to move away from the screw head. Therefore, as the adjustment nut is moving away from screw head so does the adjustment bar 305 due to the adjustment nut being located within the aperture 313 of the adjustment bar.

That is, looking at FIG. 4A, the adjustment bar 305 is caused to move in a direction as indicated by the arrow 403.

As the roller assembly is attached to a door of some considerable weight, force is applied to the bottom of the wheels 325. This weight force tends to force the carriage assembly to a retracted position, such that the support portion 323 is in contact with the engagement surface 311 on the extending member 309. During adjustment of the roller assembly from an extended to a retracted position, the movement of the engagement surface allows movement of the carriage assembly under this weight force. During adjustment of the roller assembly from a retracted position to an extended position, the engagement surface pushes against the carriage assembly to move it against this weight force.

The support portion 323 contacts the engagement surface 301 at a contact point 405. In the embodiment shown, the support portion has a round surface that is concentric with the pivot points so that the engagement surface of the extending member engages with the round surface of the support portion when the intermediate adjusting mechanism moves lengthwise.

As the carriage assembly includes the pivot points 107 that are located within the slanted passages 109, the carriage assembly is caused to move along the slanted passages 109 in a diagonal direction as shown by the arrow 407 and in a generally upwards direction as indicated by the arrow 401 which is generally perpendicular to the lengthwise movement 403 of the adjusting bar.

Further, the carriage assembly is able to pivot freely about the pivot points 107 as indicated by the arrow 409. As the carriage assembly can freely pivot, this means that the wheels 325 of the carriage assembly can automatically level themselves on the surface upon which the roller assembly is located, i.e. the wheels are self levelling. This ensures that both wheels are in contact with the supporting surface or track, and the load is evenly distributed between the wheels. When the carriage assembly pivots, the round surface of the support portion slips against the engagement surface of the extending member and provides little resistance to this pivoting motion.

Figure 5A:
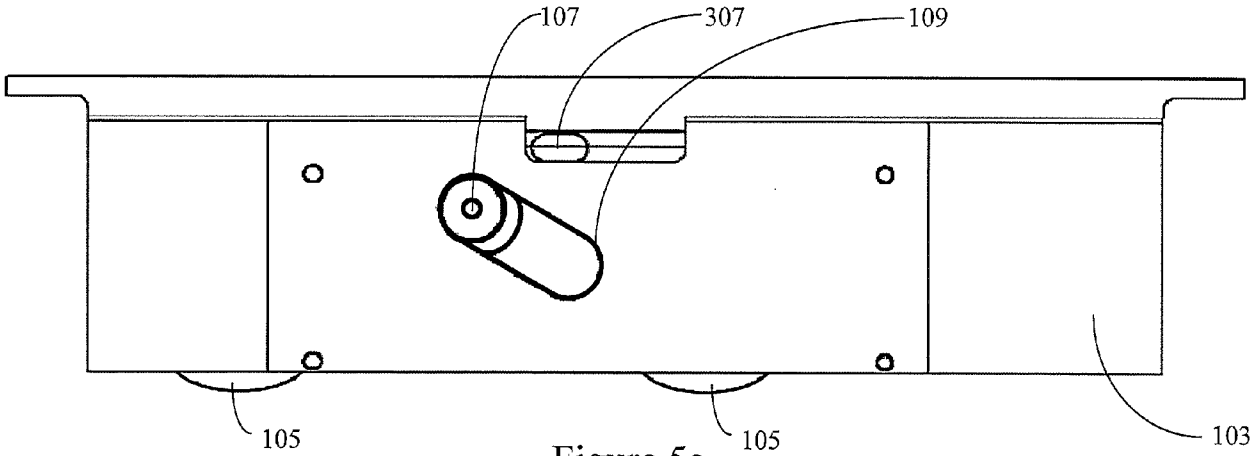
FIG. 5A is a side view of a roller assembly in the position of FIG. 4A.

FIG. 5A is a side view of the roller assembly, with the carriage assembly in the same position as FIG. 4A. As shown, the pivot points 107 have moved to the top of their respective slanted passages 109. The adjusting bar has moved fully to the left (as shown) as is clear from the position of the protrusion 307. The wheels 105 are retracted into the enclosure.

Figure 4B:
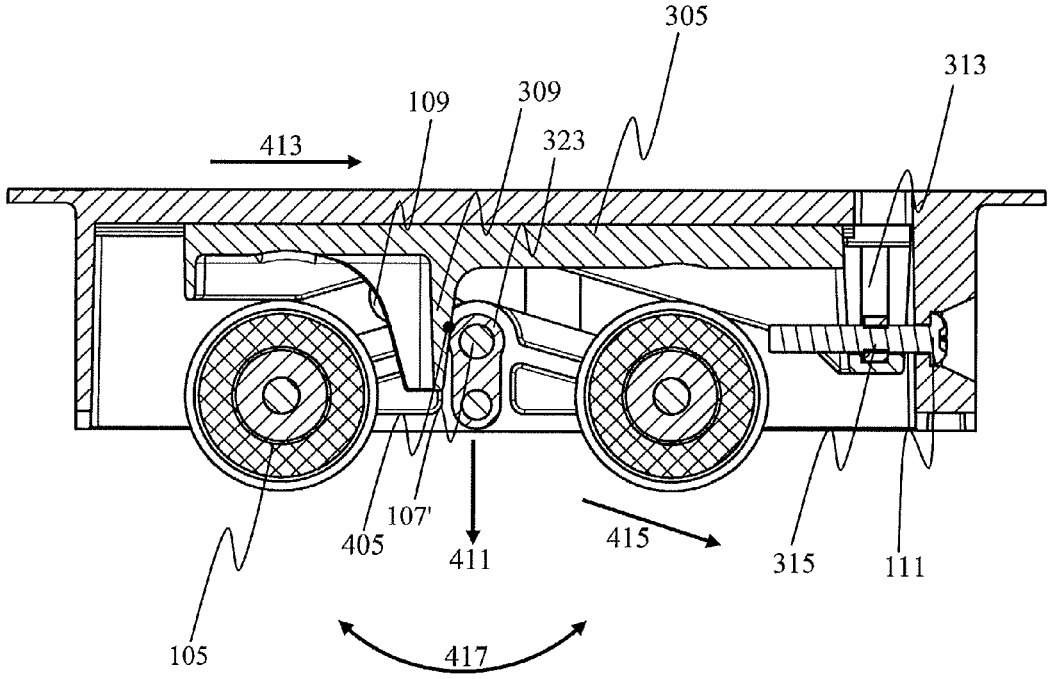
FIG. 4B shows a cross sectional view of a roller assembly in a second position according to an embodiment of the present invention.

FIG. 4B shows a cross sectional view of the roller assembly with various components arranged in a second position. According to this view, the carriage assembly has been adjusted using the adjustment mechanism so that it is protruding from the roller housing at its maximum extension The adjustment screw 111 is turned clockwise to move the nut 315 along the length of the screw towards the screw head. This causes the adjustment bar 305 to move in a lengthwise direction shown by the arrow 413. The movement of the adjustment bar 305 in the direction 413 causes the engagement surface 311 on the extending member 309 to push against the support portion 323 on the carriage assembly at the contact point 405.

The force of the extending member 309 pushing against the support portion three and 23 causes the carriage assembly to move in the direction of the arrow 415 along the slanted passages 109. This causes the carriage assembly to move in a downwards direction 411 which is generally perpendicular to the lengthwise movement 413 of the adjusting bar 305.

Although the engagement surface 311 is pushing against the support portion 323 on the carriage assembly, the carriage assembly is still able to pivot freely 417 about the pivot point 107. Again, as the carriage assembly is able to pivot freely the wheels are able to self level upon the surface upon which the roller housing is operating.

Figure 5B:
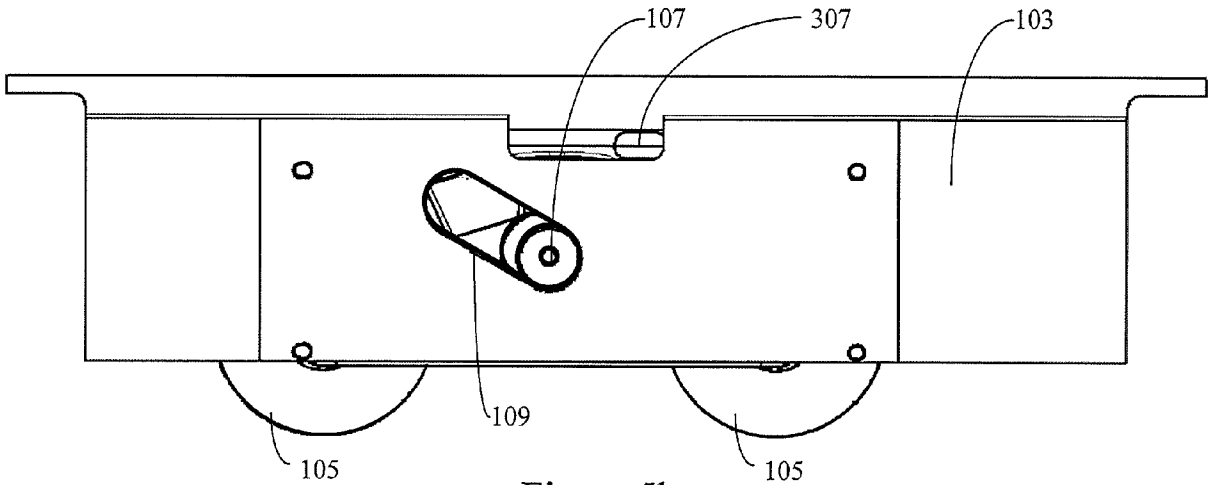
FIG. 5B is a side view of a roller assembly in the position of FIG. 4B.

FIG. 5B is a side view of the roller assembly, with the carriage assembly in the same position as FIG. 4B. As shown, the pivot points 107 have moved to the bottom of their respective slanted passages 109. The adjusting bar has moved fully to the right (as shown) as is clear from the position of the protrusion 307. The wheels 105 are extended from the enclosure.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

The invention claimed is:

1. A roller assembly comprising:

a roller housing comprising first and second side walls;

a carriage assembly comprising a carriage body and at least two carriage wheels rotatably attached to the carriage body, wherein the carriage assembly is located within the housing such that the at least two carriage wheels are arranged to protrude from the bottom of the housing during use;

wherein the carriage body comprises a support portion and at least two pivot points defining a pivot axis, the pivot points being arranged to locate within slanted passages formed in the first and second side walls, the carriage body being free to rotatably pivot about the pivot axis;

an intermediate adjusting mechanism slidably engaged with the roller housing and arranged to move lengthwise with respect to the housing, the intermediate adjusting mechanism comprising a first engagement surface arranged to engage with the support portion, wherein the first engagement surface is located on an extending member, wherein the extending member extends in a direction substantially perpendicular to the lengthwise movement of the intermediate adjusting mechanism; and an adjustment mechanism accessible from a first end of the housing, wherein movement of the adjustment mechanism causes the intermediate adjusting mechanism to move lengthwise with respect to the housing, wherein the movement of the intermediate adjusting mechanism causes or allows the carriage body to move along the slanted passages;

wherein the support portion comprises a round surface that is concentric with the pivot points and the first engagement surface of the extending member is arranged to engage with the round surface when the intermediate adjusting mechanism moves lengthwise.

2. The roller assembly of claim 1 wherein the adjustment mechanism is arranged to be moved rotationally within an adjustment aperture.

3. The roller assembly of claim 1 wherein the lengthwise movement of the intermediate adjusting mechanism has no vertical component.

4. The roller assembly of claim 1 wherein the roller housing further comprises a first lengthwise adjustment passage located on the first side wall and a second lengthwise adjustment passage located on the second side wall, wherein the intermediate adjusting mechanism further comprises a first protrusion arranged to move within the first lengthwise adjustment passage and a second protrusion arranged to move within the second lengthwise adjustment passage.

5. The roller assembly of claim 1 wherein the adjustment mechanism comprises a rotatable element that engages with a fixed element, wherein the fixed element engages with the intermediate adjusting mechanism such that the rotation of the rotatable element causes the fixed element to move along the length of the rotatable element thus causing the intermediate adjusting mechanism to move lengthwise.

6. The roller assembly of claim 5 wherein the rotatable element is an adjustment screw and the fixed element is a corresponding adjustment nut, wherein the adjustment nut is located within an adjustment nut aperture formed within the intermediate adjusting mechanism.

7. The roller assembly of claim 5 wherein the fixed element is formed integrally with the intermediate adjusting mechanism.

8. The roller assembly of claim 1 wherein the carriage assembly further comprises at least two shafts, each shaft being arranged to pass through a central aperture formed in one of the carriage wheels to enable that carriage wheel to rotate relative to the carriage assembly.

9. The roller assembly of claim 1 wherein the slanted passages comprise a first slanted passage formed in the first wall and a second slanted passage formed in the second wall, where the first and second slanted passages are aligned and slant in the same direction.

10. The roller assembly of claim 9 wherein the pivot points comprise a first pivot point arranged to locate within the first slanted passage and a second pivot point arranged to locate within the second slanted passage.

11. The roller assembly of claim 1 wherein the first engagement surface acts against the support portion to hold the carriage body in position when it is not being adjusted.

12. The roller assembly of claim 1, wherein the roller housing further includes first and second end walls.

* * * * *